US007229388B2

(12) United States Patent
Yang

(10) Patent No.: US 7,229,388 B2
(45) Date of Patent: Jun. 12, 2007

(54) EXERCISE ROWING MACHINE

(76) Inventor: Lien-Chuan Yang, 11F-1, No. 149, Sec. 3, Roosevelt Rd., Taipei (TW)

( * ) Notice: Subject to any disclaimer, the term of this patent is extended or adjusted under 35 U.S.C. 154(b) by 85 days.

(21) Appl. No.: 11/246,181

(22) Filed: Oct. 11, 2005

(65) Prior Publication Data

US 2007/0099770 A1 May 3, 2007

(51) Int. Cl.
*A63B 69/06* (2006.01)
*A63B 69/08* (2006.01)

(52) U.S. Cl. ..... 482/72; 482/73

(58) Field of Classification Search ..... 482/72–73, 482/111–113, 95–96, 51, 53
See application file for complete search history.

(56) References Cited

U.S. PATENT DOCUMENTS 4,563,000 A * 1/1986 Gall ..... 482/72
5,441,469 A * 8/1995 Chern ..... 482/72
5,512,027 A * 4/1996 Chen ..... 482/72
5,928,116 A * 7/1999 Chiang ..... 482/72
6,093,135 A * 7/2000 Huang ..... 482/72
7,022,052 B1 * 4/2006 Lai ..... 482/72
7,115,077 B2 * 10/2006 Yang ..... 482/73
2006/0189455 A1 * 8/2006 Yang ..... 482/73

* cited by examiner

*Primary Examiner*—Fenn C. Mathew
(74) *Attorney, Agent, or Firm*—Lowe Hauptman & Berner, LLP

(57) ABSTRACT

An exercise rowing machine comprising: a main shank pivotally connected therebeneath with a linking-up member at its central area, the linking-up member has a transverse rod with two first connecting portions respectively on its two ends to correspondingly connect with the second connecting portions; and positioning members are provided to fix and release the first and the second connecting portions, so that the connecting rods and the transverse rod can be stretched out, and the operating rods can be collapsed and folded to be within a bottom surface of the main shank to reduce the space for storing and transporting; the main shank is provided on its rear end with a rear supporting stand able to be rotated and positioned to adjust the raising and lowering angle of the main shank relative to a front supporting stand, so that a user can obtain different effects of exercising in pursuance of different requirements.

6 Claims, 7 Drawing Sheets

EXERCISE ROWING MACHINE

BACKGROUND OF THE INVENTION

1. Field of the Invention

The present invention relates to an exercise rowing machine; and more particularly to a foldable exercise rowing machine with a rear supporting stand on the rear end of a main shank being adjustable in angular position.

2. Description of the Prior Art

Training rowing machines had been used widely for decades. They mainly are used to strengthen muscles on hands, legs, chests, waists and backs thus can be deemed as training machines for whole body.

FIG. 7 depicts a conventional training rowing machine which includes a main shank "a" and a supporting rack a1 in connecting with the main shank "a", the main shank "a" is provided thereon with a seat a2, the supporting rack a1 is pivotally connected with two oil pressure cylinders a3 and two handles a4 at its two lateral sides. Each handle a4 is linked up with an oil pressure cylinder a3. The supporting rack a1 is provided on its front end with two pedals a5. When a user seats on the seat a2 with his two feet stepping on the two pedals a5 respectively, he can pull the two handles a4 with his hands against the resisting force provided by the oil pressure cylinders a3. When the handles a4 are pulled rearwards for a distance, they can be moved forwards back to their original positions by the restoring forces of the oil pressure cylinders a3, this provides the user to and fro actions simulating rowing boats.

The above stated training rowing machine can effectively obtain a function of body exercising. However, its supporting rack a1 is overly wide, and its handles a4 are not foldable, this makes its entire volume being quite bulky and inconvenient in storage and transporting.

In order to get rid of the defects stated above to render a rowing machine foldable, and effective in reducing the space for storing, the inventor provides the present invention based on his professional experience of years and nonstop studying as well improvement.

SUMMARY OF THE INVENTION

The main objective of the present invention is to provide an exercise rowing machine, by having a positioning member to fix or release a set of connecting portions including a first and a second connecting portion respectively in inclined orientations, operating rods on two sides of a main shank can be stretched out or collapsed and folded to be within the bottom surface of the main shank, thus space for storing and transporting can be reduced.

The secondary objective of the present invention is to provide an exercise rowing machine; by having a rear supporting stand pivotally connected to the rear end of the main shank, the rear supporting stand is positioned after rotating to adjust the raising and lowering angle of the main shank relative to a front supporting stand, so that a user can obtain different effects of exercising in pursuance of different requirements.

Therefore, in order to achieve the above stated objectives, the exercise rowing machine of the present invention is comprised of a main shank, a front and a rear supporting stand respectively on the front and rear ends of the main shank; the main shank is provided on its front end with two lateral pedals, and is provided thereon with a seat slidable relatively to the main shank. The main shank is pivotally connected therebeneath with a linking-up member at its central area, the linking-up member is connected with two operating rods and an elastic restoring device, so that the two operating rods can be swung to and fro under a force. The main features of the present invention are as below:

The linking-up member has a transverse rod with two first connecting portions respectively on its two ends, the first connecting portions are inclined each for an angle against the axis of the transverse rod, and are provided each with a positioning portion.

The operating rods each includes a handle and a connecting rod able to rotate relatively to each other, a second connecting portion is provided on one end of each connecting rod; the second connecting portions are inclined each for an angle against the axis of a corresponding connecting rod to correspondingly connect with a first connecting portion; and positioning members are provided to movably connect the two second connecting portions to the positioning portions of the corresponding first connecting portions, so that the connecting rods and the transverse rod are fixed in a stretched out state, and the handles as well as the connecting rods can be collapsed and folded to be within the bottom surface of the main shank after releasing the positioning members.

Thereby, the two operating rods can be collapsed and folded to be within the bottom surface of the main shank to effectively reduce the space for storing and transporting.

Moreover, the abovementioned rear supporting stand pivotally connected to the rear end of the main shank is provided on its top with an engaging portion, and the main shank is provided therebeneath on its rear end with a supporting portion that has thereon a plurality of positioning slots to receive the engaging portion of the rear supporting stand, in order to adjust the raising and lowering angle of the main shank relative to the front supporting stand, so that a user can get different effects of exercising in pursuance of different requirements.

The present invention will be apparent after reading the detailed description of the preferred embodiment thereof in reference to the accompanying drawings.

DETAILED DESCRIPTION OF THE PREFERRED EMBODIMENT

Figure 1:
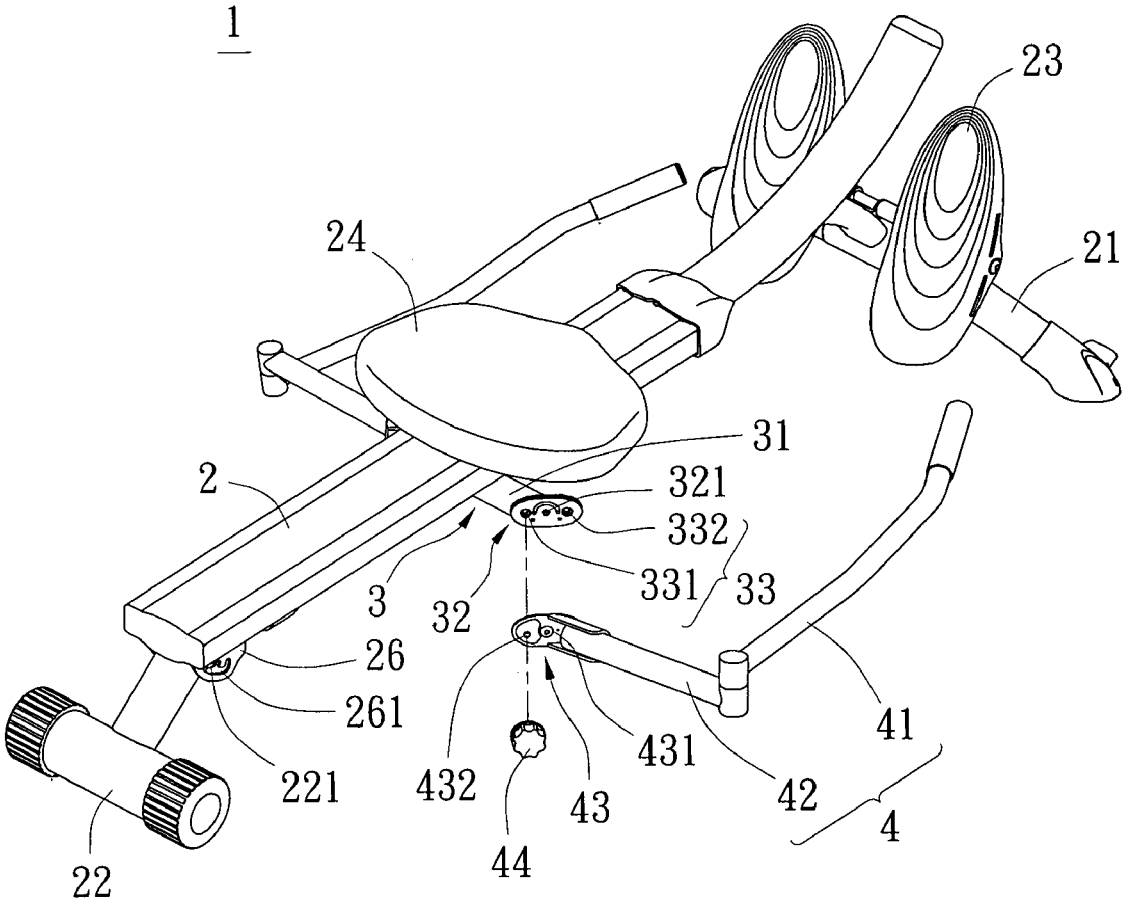
FIG. 1 is an exploded perspective view showing the elements of an embodiment of the present invention.
Figure 2:
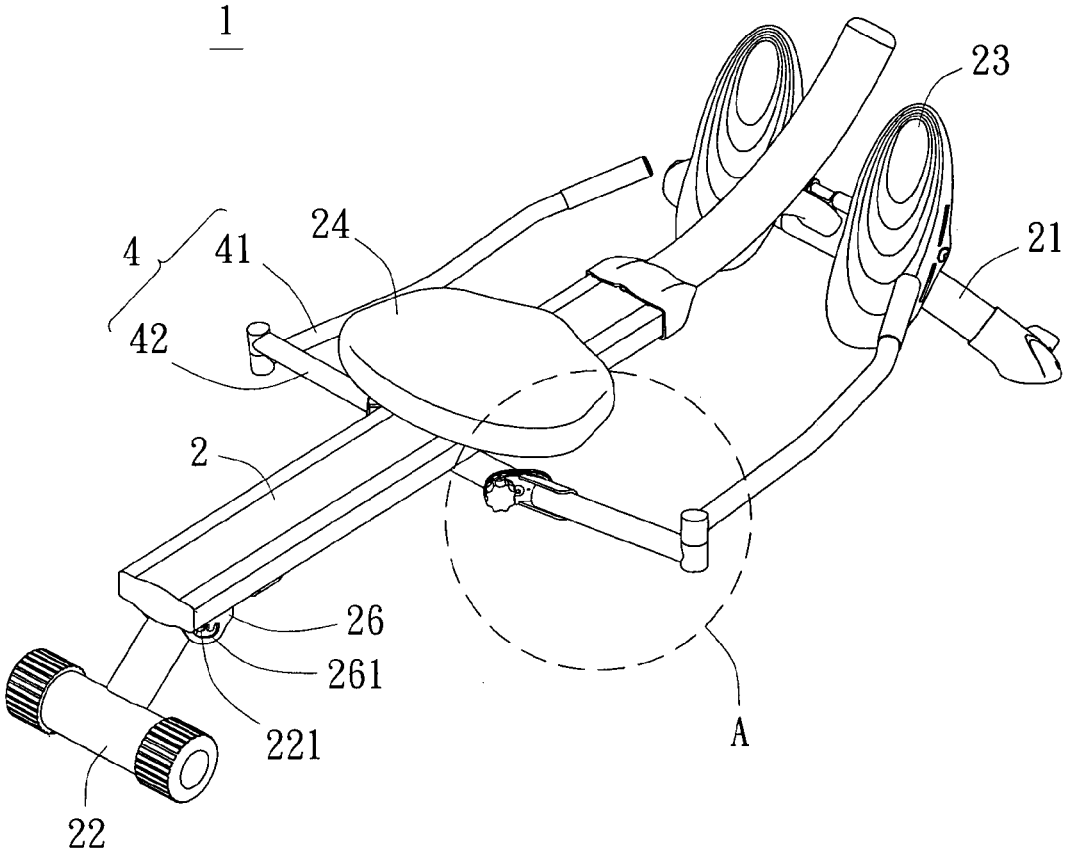
FIG. 2 is a perspective view of the embodiment of the present invention.

Referring to FIGS. 1, 2 showing a preferred embodiment of the exercise rowing machine 1 of the present invention, the machine is comprised of an elongate main shank 2, two supporting stands 21, 22 are provided respectively on a front and a rear end of the main shank 2; the main shank 2 is provided respectively on two laterals of its front end with two pedals 23, and is provided thereon with a seat 24 slidable relatively to the main shank 2. The main shank 2 is pivotally connected therebeneath with a linking-up member 3 at its central area, the linking-up member 3 is connected on its two sides respectively with two operating rods 4, and is provided at its central area with a buffer forming an elastic restoring device 25. When in use, a user seats on the seat 24 with his feet stepping on the two pedals 23; and when the two hands of the user push and pull the operating rods 4, the two operating rods can be swung to and fro under a force exerted to obtain an effect of body exercising.

The linking-up member 3 includes a transverse rod 31 which has on its two ends each a flat plate forming a first connecting portion 32. The plane surfaces of the first connecting portions 32 are inclined each for an angle against the axis of the transverse rod 3, and are provided at the central areas of each of them with an axial hole 321; a first screw hole 331 and a second screw hole 332 are provided at the two lateral sides of each of the first connecting portions 32, the two screw holes 331, 332 function as positioning portions 33.

Each of the operating rods 4 includes a handle 41 and a connecting rod 42, one end of the handle 41 is connected with one end of the connecting rod 42, so that the handle 41 and the connecting rod 42 are able to rotate relatively to each other. The other end of each connecting rod 42 has thereon a flat plate forming a second connecting portion 43. The plane surfaces of the second connecting portions 43 are inclined each for an angle against the axis of a corresponding connecting rod 42, and are provided at the central areas of each of them with an axial hole 431, each axial hole 431 has at one side of it a hole 432.

The first and the second connecting portions 32, 43 are abut connected with each other, the axial holes 321 of the first connecting portions 32 are coaxially connected with their corresponding axial holes 431 of the second connecting portions 43, so that the axes of the transverse rod 31 and the connecting rods 42 are aligned in a line (or can be parallel mutually). By extending of bolts through the holes 432 of the second connecting portions 43, and the two screw holes 331, 332 of the positioning portions 33 of the first connecting portions 32, the first and the second connecting portions 32, 43 can be connected mutually, and then the connecting rods 42 and the transverse rod 31 of the linking-up member 3 can be mutually connected and locked. The abovementioned bolts function as positioning members 44.

Figure 3:
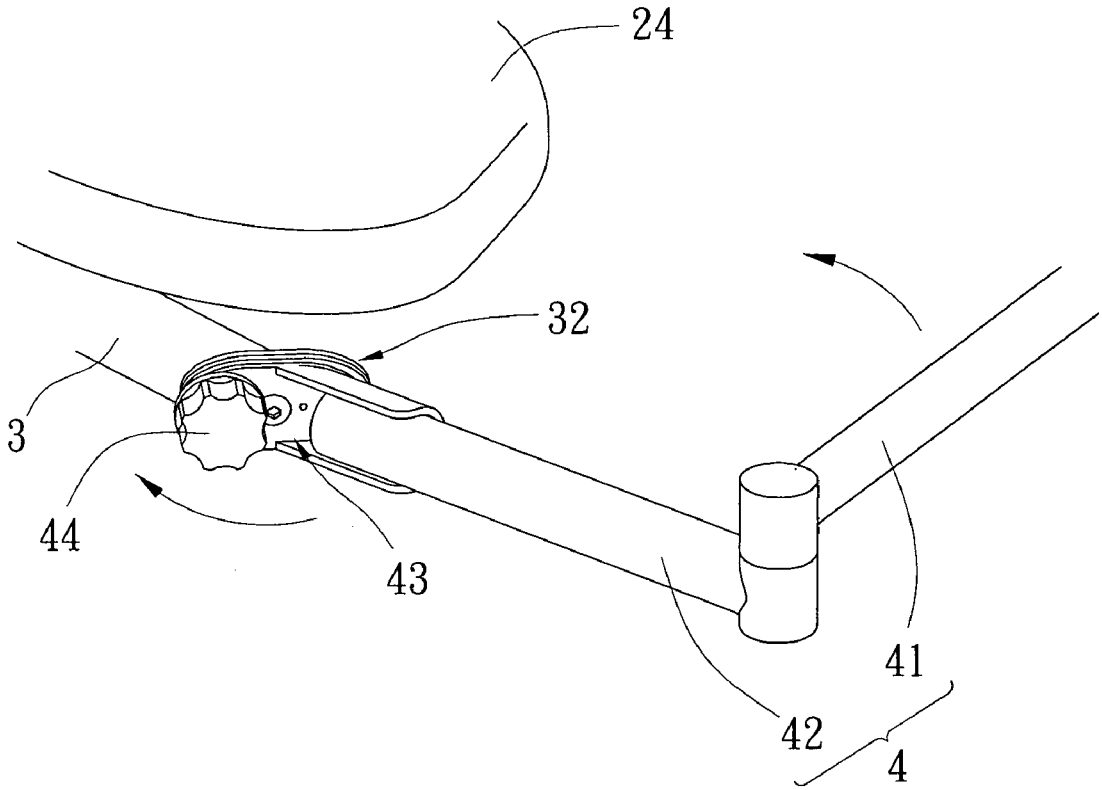
FIG. 3 is a partial enlarged side view taken from an "A" part in FIG. 2.
Figure 4:
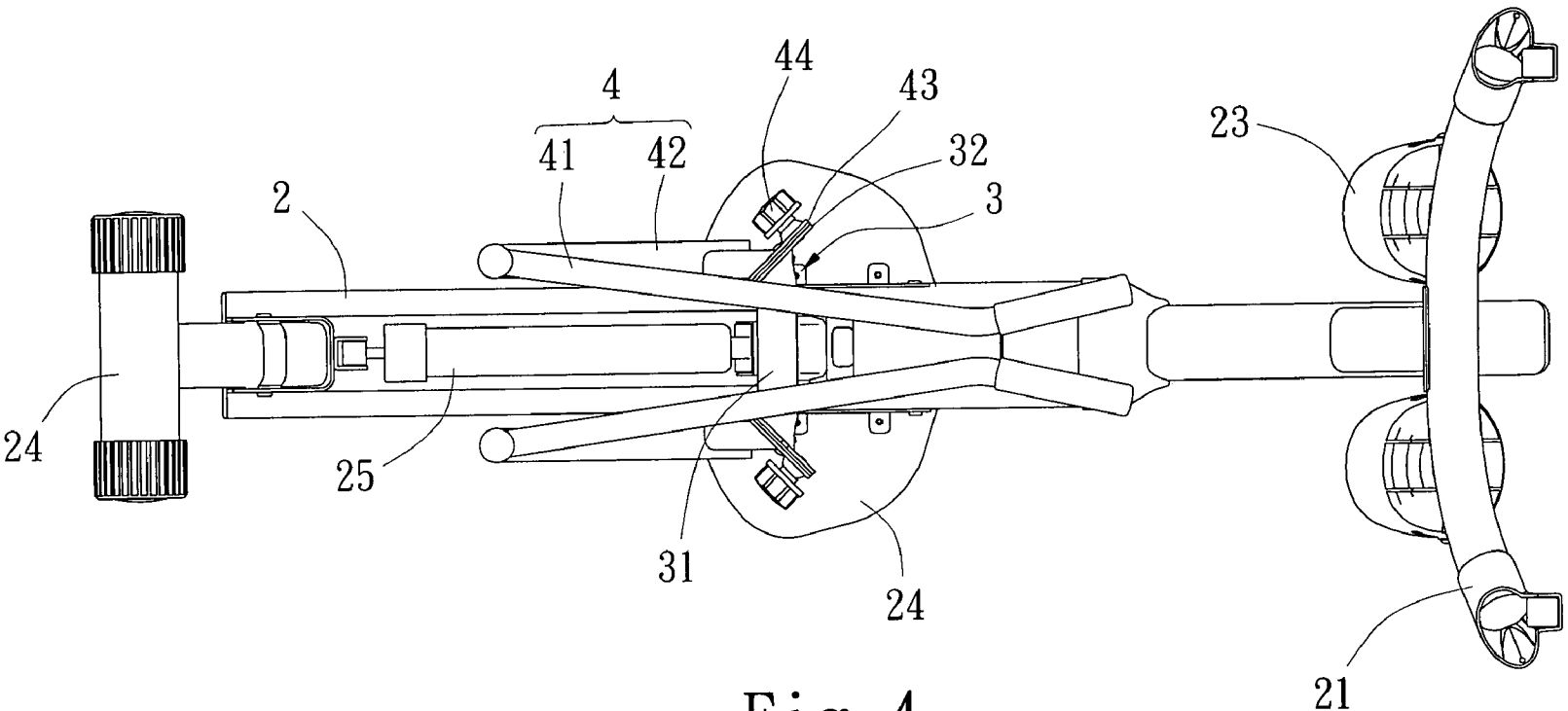
FIG. 4 is a bottom view showing the state when operating rods of the present invention are collapsed and folded.
Figure 5:
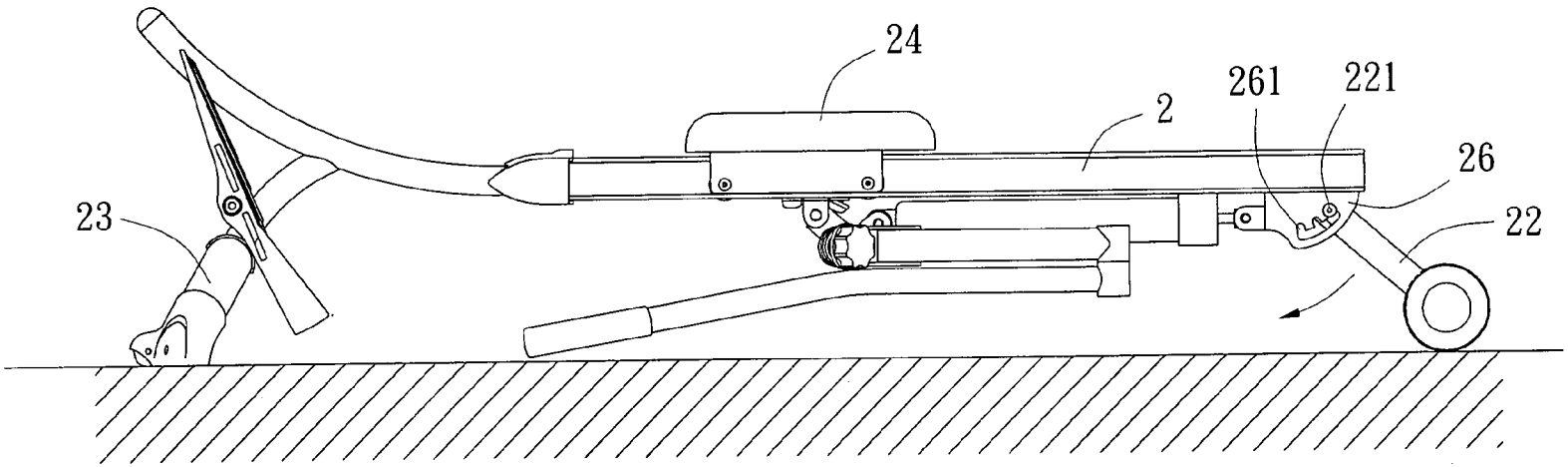
FIG. 5 is a side view showing the state when operating rods of the present invention are collapsed and folded.

Referring to FIGS. 3–5, when in stretching out the operating rods 4 for rowing for exercising for body building, the first and the second connecting portions 32, 43 are coaxially connected, while the positioning members 44 connect and lock the holes 432 of the second connecting portions 43 to the first screw holes 331 of the positioning portions 33 of the first connecting portions 32. When in collapsing and folding the operating rods 4, to release the positioning members 44 can allow the second connecting portions 43 to rotate relatively to the first connecting portions 32, and meantime the operating rods 4 rotate in inclined angular positions against the transverse rod 31 of the linking-up member 3. When the handles 41 and the connecting rods 42 of the operating rods 4 are collapsed and folded to be within the bottom surface of the main shank 2, by connecting and locking of the holes 432 of the second connecting portions 43 to the second screw holes 332 of the positioning portions 33 of the first connecting portions 32 by operation of the positioning members 44, the operating rods 4 are fixed in the collapsed and folded state.

When in practical application, connecting of the first and the second connecting portions 32, 43 is not limited to the mode of locking; it is feasible that the positioning portions 33 of the first connecting portions 32 are two round holes, while the positioning members 44 are expansion rods (or snap catches), they can also be used to engage the first connecting portions 32 with the second connecting portions 43 and thus fix them.

Figure 6:
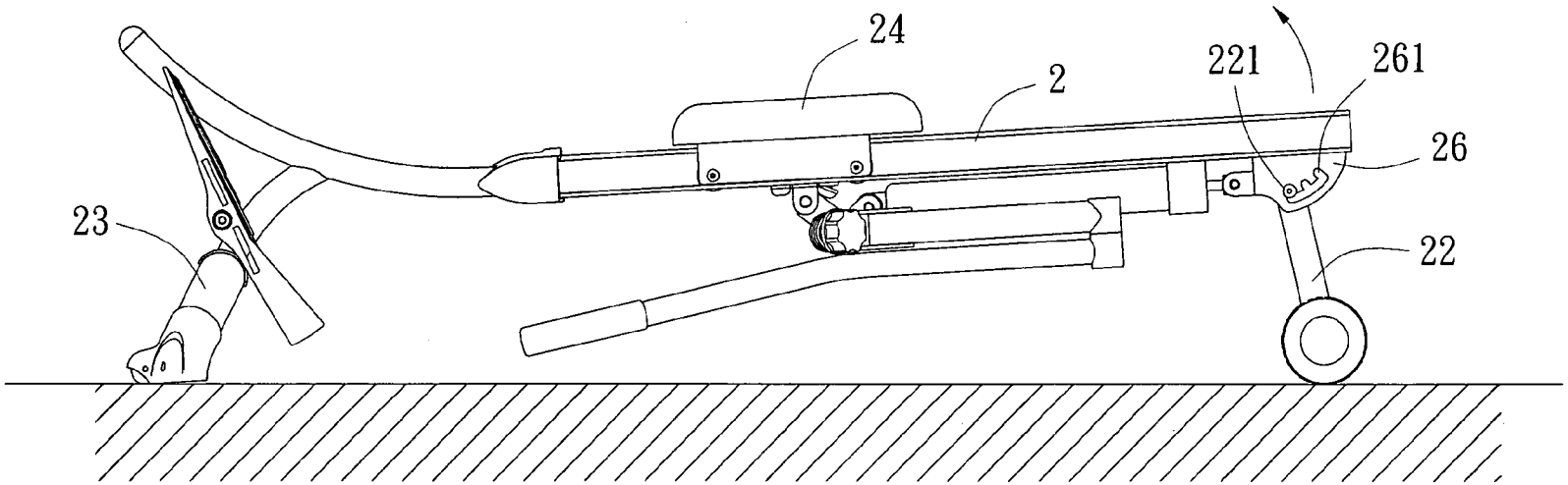
FIG. 6 is a schematic view showing rotating of a rear supporting stand relative to the rear end of the main shank in use.
Figure 7:
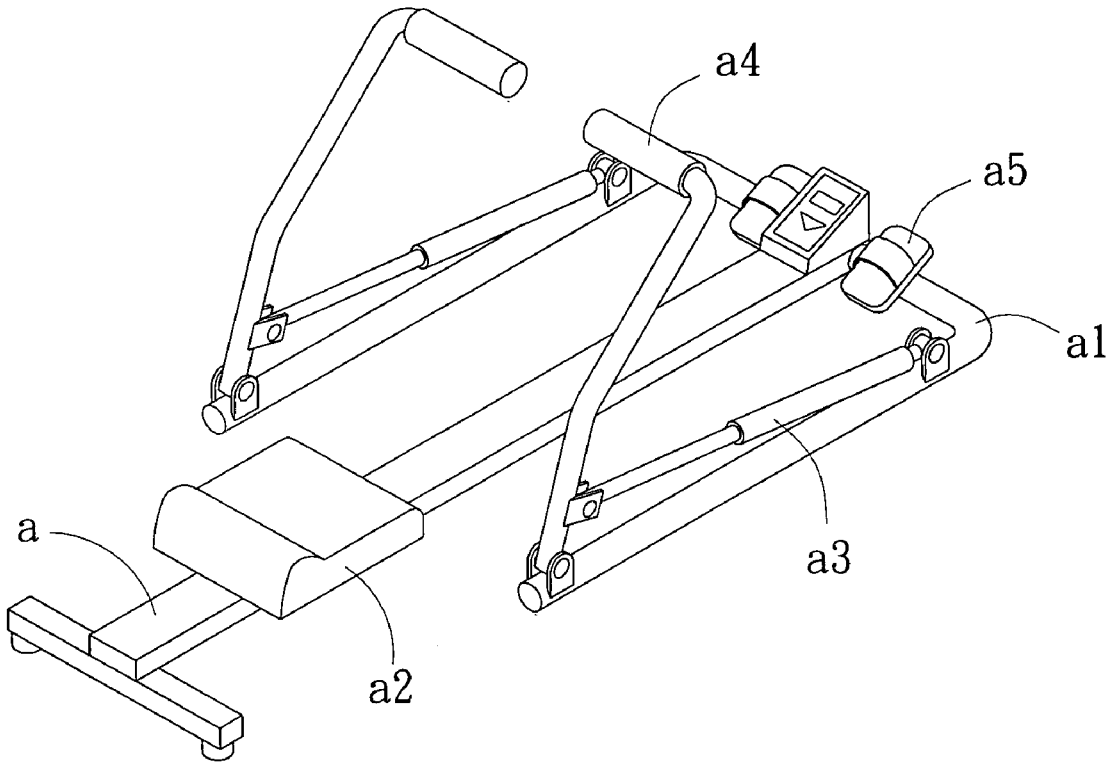
Fig. 7 (Prior Art)
FIG. 7 is a perspective view showing the appearance of a conventional training rowing machine.

Referring to FIGS. 5, 6, the upper end of the rear supporting stand 22 of the present invention is pivotally connected to the rear end of the main shank 2, so that the rear supporting stand 22 can be rotated relatively to the rear end of the main shank 2. The upper end of the rear supporting stand 22 further is provided with protruding cylinders to be engaging portions 221; the rear end of the main shank 2 is provided therebeneath with a pair of flat plates symmetrically allocated to be a supporting portion 26 of which plate surfaces form a plurality of mutually communicating positioning slots 261.

When the rear supporting stand 22 is rotated relatively to the rear end of the main shank 2, the engaging portions 221 of the rear supporting stand 22 can be respectively received in a corresponding one of the positioning slots 261, for the purpose that the rear end of the main shank 2 can be raised or lowered relatively to the front supporting stand 21, in order to adjust the main shank 2 relatively to the angular raising and lowering of the front supporting stand 21 to get different effects of exercising.

The present invention thereby has the following advantages:

1. By having a positioning member to fix or release a set of connecting portions including a first and a second connecting portion respectively in inclined orientations, the operating rods on two sides of the main shank can be stretched out or collapsed and folded to effectively reduce the space for storing and transporting.
2. By adjusting the angular position of the main shank relatively to that of the front supporting stand, a user can obtain different amounts of exercising; the present invention thus is quite flexible in practical use.

According to the above disclosed, the present invention can surely obtain the expected objectives to provide an exercise rowing machine which is convenient for folding and collapsing and effective to reduce storing space; it is extremely industrially valuable.

The invention claimed is:

1. An exercise machine comprising;

a main shank, two supporting stands provided respectively on a front and rear end of said main shank, said main shank is provided on its front end with two lateral pedals, and is provided thereon with a seat slidable relative to said main shank; said main shank is pivotally connected therebeneath with a linking-up member at its central area, said linking-up member is connected with two operating rods and an elastic storing device, so that said operating rods are adapted to swing to and fro under a force, improvement of said exercise rowing machine is:

said linking-up member has a transverse rod with two first connecting portions respectively on its two ends, said first connecting portions are each inclined at an angle against an axis of said transverse rod, and are provided each with a positioning portion;

said operating rods each includes a handle and a connecting rod able to rotate relative to each other, a second connecting portion is provided on one end of each of the connecting rods; said second connecting portions are each inclined at an angle against an axis of a corresponding one of said connecting rods to correspondingly connect with one of said first connecting portions; and positioning members are provided to movably connect said two second connecting portions to said positioning portions of corresponding ones of said first connecting portions, so that said connecting rods and said transverse rod are fixed in a stretched out state, and said handles as well as said connecting rods are adapted to be collapsed and folded to be within a bottom surface of said main shank after releasing said positioning members.

2. The exercise rowing machine as in claim 1, wherein said transverse rod and said connecting rods are coaxial when they are correspondingly connected.

3. The exercise rowing machine as in claim 1, wherein axes of said transverse rod and said connecting rods are parallel mutually when they are correspondingly connected.

4. The exercise rowing machine as in claim 1, wherein said positioning portions of said first connecting portions are screw holes, while said positioning members of said second connecting portions are bolts, so that said first and said second connecting portions are adapted to connecting mutually.

5. The exercise rowing machine as in claim 1, wherein said positioning portions of said first connecting portions are round holes, while said positioning members of said second connecting portions are expansion rods, so that said first and said second connecting portions are adapted to connecting mutually.

6. The exercise rowing machine as in claim 1, wherein one of said supporting stands provided on said rear end of said main shank is pivotally connected to a rear end of said main shank and is provided on its top with an engaging portion, and said main shank is provided therebeneath on said rear end with a supporting portion that has thereon a plurality of positioning slots to receive said engaging portion of said supporting stand, in order to adjust a raising and lowering angle of said main shank relative to the other of said supporting stands provided on said front end of said main shank.

* * * * *